US008781340B2

(12) United States Patent
Matsuda

(10) Patent No.: US 8,781,340 B2
(45) Date of Patent: Jul. 15, 2014

(54) IMAGE FORMING APPARATUS, IMAGE FORMING METHOD, AND STORAGE MEDIUM

(71) Applicant: Kohji Matsuda, Kanagawa (JP)

(72) Inventor: Kohji Matsuda, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 23 days.

(21) Appl. No.: 13/737,170

(22) Filed: Jan. 9, 2013

(65) Prior Publication Data

US 2013/0183051 A1 Jul. 18, 2013

(30) Foreign Application Priority Data

Jan. 16, 2012 (JP) ..... 2012-006281

(51) Int. Cl.
*G03G 15/00* (2006.01)

(52) U.S. Cl.
USPC ..... 399/12; 399/49; 399/72

(58) Field of Classification Search
USPC ..... 399/12, 49, 72
See application file for complete search history.

(56) References Cited

U.S. PATENT DOCUMENTS

| | | | | |
|---|---|---|---|---|
| 6,243,542 | B1 * | 6/2001 | Fujimoto et al. | 399/49 |
| 7,826,089 | B2 | 11/2010 | Inoue | |
| 7,933,526 | B2 | 4/2011 | Kanai | |
| 2005/0157351 | A1 | 7/2005 | Matsuda | |
| 2006/0126125 | A1 | 6/2006 | Matsuda et al. | |
| 2006/0262341 | A1 | 11/2006 | Matsuda | |
| 2007/0242966 | A1 | 10/2007 | Itagaki et al. | |
| 2007/0285708 | A1 | 12/2007 | Matsuda | |
| 2008/0145071 | A1 | 6/2008 | Ogasawara | |
| 2009/0231633 | A1 | 9/2009 | Matsuda | |
| 2010/0046013 | A1 * | 2/2010 | Bonikowski et al. | 358/1.9 |
| 2010/0053687 | A1 | 3/2010 | Matsuda | |
| 2011/0229171 | A1 * | 9/2011 | Hirai | 399/49 |
| 2012/0219306 | A1 | 8/2012 | Shiomichi et al. | |
| 2012/0243883 | A1 * | 9/2012 | Eom | 399/12 |
| 2013/0251388 | A1 * | 9/2013 | Tanaka | 399/49 |
| 2014/0072317 | A1 * | 3/2014 | Shukuya et al. | 399/49 |

FOREIGN PATENT DOCUMENTS

| | | | |
|---|---|---|---|
| JP | 2004-304773 | 10/2004 | |
| JP | 2005-229475 | 8/2005 | |
| JP | 2006-155499 | 6/2006 | |
| JP | 2008-170474 | 7/2008 | |
| JP | 2011112704 A * | 6/2011 | G03G 15/01 |

OTHER PUBLICATIONS

Extended European search report dated Jul. 18, 2013.

* cited by examiner

*Primary Examiner* — Christopher Mahoney
(74) *Attorney, Agent, or Firm* — IPUSA, PLLC

(57) ABSTRACT

An image forming apparatus includes an imaging unit configured to form pattern images in areas corresponding to positions at which toners including a specific color toner of a specific color are provided; a reading unit configured to read the formed pattern images; a color information detection unit configured to analyze color information of the read pattern images and detect the color information of the specific color toner; a position determination unit configured to determine the position at which the specific color toner is provided from a position at which the pattern image of the specific color is formed in the read pattern images; and a recording unit configured to record the detected color information of the specific color toner and the position at which the specific color toner is provided.

8 Claims, 12 Drawing Sheets

IMAGE FORMING APPARATUS, IMAGE FORMING METHOD, AND STORAGE MEDIUM

CROSS-REFERENCE TO RELATED APPLICATION

The present application is based upon and claims the benefit of priority of Japanese Patent Application No. 2012-006281, filed on Jan. 16, 2012, the entire contents of which are incorporated herein by reference.

BACKGROUND OF THE INVENTION

1. Field of the Invention

The present invention relates to an image forming apparatus, an image forming method, and a storage medium.

2. Description of the Related Art

In the printing industry, color toners of cyan (C), magenta (M), yellow (Y), and black (K), which are called "process color," are commonly used. However, a specific color such as a corporate color used in a particular corporation may not be expressed with process color when it is desired to ensure its beautiful expression. Therefore, a so-called specific color toner produced by original blending is commonly used. In printers capable of using a specific color toner, part of an image of a specific color is printed using the specific color toner, while the other part of the image is printed using process color toners.

However, in order to perform printing that precisely expresses a specific color in a general-purpose image forming apparatus, it is necessary to define the specific color in the apparatus body or on an application for printing (a printing application). The specific color is a color of an original blend based on a customer's request. Therefore, in the case of forming an image of the specific color using four color toners of C, M, Y, and K, it is necessary to measure color components with a colorimeter and register the measured color components with the image forming apparatus in order to express the specific color as precisely as possible.

Japanese Patent Application No. 2006-155499 discloses a technique related to an image forming system that includes a specific color registration determination part configured to determine whether to register a specific color in a host computer, an image data generation part configured to generate image data in the host computer, a specific color data detection part configured to retrieve specific color data from the image data generated by the image data generation part, an image forming part configured to form an image from the image data, and a specific color registration part configured to register the specific color data detected by the specific color detection part with the image forming part.

Japanese Laid-Open Patent Application No. 2005-229475 discloses a technique related to a data converter that includes a storage part configured to store a specific color and a corresponding combination of the amounts of process colors in correlation with each other, a combination candidate generation part configured to generate multiple combination candidates including the combination, a patch image creating part configured to cause an output device to output multiple color patches corresponding to the respective combination candidates, a color patch specifying part configured to receive a specified one of the color patches, a combination updating part configured to replace the combination of the amounts of process colors stored in the storage part with the combination candidate of the specified color patch, an image data obtaining part configured to obtain first image data representing an image including the specific color, and an image data conversion part configured to convert the first image data into second image data where the specific color is reproduced with the corresponding combination of the amounts of process colors correlated with the specific color.

Thus, conventionally, image forming apparatuses are common that express a specific color using four color toners of C, M, Y, and K, while in recent years, image forming apparatuses capable of performing printing using a fifth and a sixth color toner have been widely used. Therefore, techniques have been proposed that print specific colors using specific color toners as a fifth and a sixth color toner.

Japanese Laid-Open Patent Application No. 2008-170474 discloses an image forming apparatus capable of using an extension function using specific toner, where it is determined whether the image forming apparatus is loaded with the specific toner, an image forming function is extended based on the determination result, and an image is formed using the specific toner with the extended function.

SUMMARY OF THE INVENTION

According to an aspect of the present invention, an image forming apparatus includes an imaging unit configured to form pattern images in areas corresponding to positions at which toners including a specific color toner of a specific color are provided; a reading unit configured to read the formed pattern images; a color information detection unit configured to analyze color information of the read pattern images and detect the color information of the specific color toner; a position determination unit configured to determine the position at which the specific color toner is provided from a position at which the pattern image of the specific color is formed in the read pattern images; and a recording unit configured to record the detected color information of the specific color toner and the position at which the specific color toner is provided.

According to an aspect of the present invention, an image forming method includes forming pattern images in areas corresponding to positions at which toners including a specific color toner of a specific color are provided; reading the formed pattern images; analyzing color information of the read pattern images and detecting the color information of the specific color toner; determining the position at which the specific color toner is provided from a position at which the pattern image of the specific color is formed in the read pattern images; and recording the detected color information of the specific color toner and the position at which the specific color toner is provided.

According to an aspect of the present invention, a non-transitory computer-readable storage medium stores a program for causing a computer to execute the image forming method as set forth above.

The object and advantages of the embodiments will be realized and attained by means of the elements and combinations particularly pointed out in the claims.

It is to be understood that both the foregoing general description and the following detailed description are exemplary and explanatory and not restrictive of the invention.

BRIEF DESCRIPTION OF THE DRAWINGS

Other objects, features and advantages of the present invention will become more apparent from the following detailed description when read in conjunction with the accompanying drawings, in which.

DETAILED DESCRIPTION OF THE PREFERRED EMBODIMENTS

As described above, Japanese Laid-Open Patent Application No. 2008-170474 discloses an image forming apparatus capable of using an extension function using specific toner. According to the technique disclosed in Japanese Laid-Open Patent Application No. 2008-170474, however, the image data of, for example, a logotype desired to be expressed with a specific color and a corresponding specific color toner are registered with the image forming apparatus in correlation with each other, so that information on the specific color is prevented from being registered. Further, the color components of the specific color toner are prevented from being determined and registered.

Further, according to Japanese Laid-Open Patent Application No. 2008-170474, the position of the toner bottle of the specific color is fixed. The position of the toner bottle affects the order of imaging. Therefore, depending on the specific color desired to be expressed, the color intended by a user may not be properly expressed when the position of the toner bottle of the specific color is fixed.

According to an aspect of the present invention, an image forming apparatus and an image forming method are provided that facilitate registration of a specific color, and a storage medium is provided where a program for causing a computer to execute the image forming method is recorded.

A description is given, with reference to the accompanying drawings, of one or more embodiments of the present invention.

[a] First Embodiment

Figure 1:
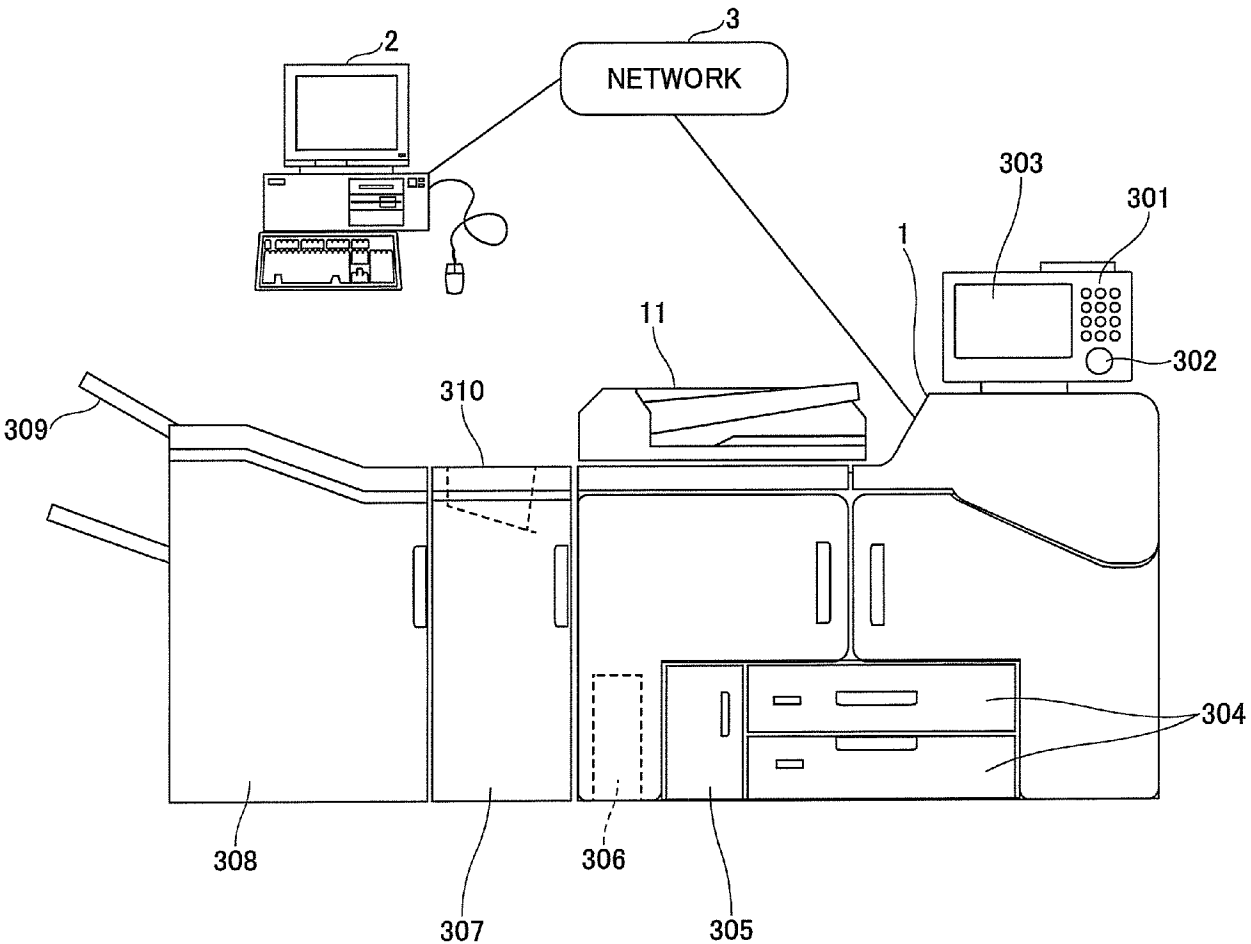
FIG. 1 is a diagram illustrating an apparatus configuration using an image forming apparatus according to a first embodiment of the present invention.

FIG. 1 is a diagram illustrating an apparatus configuration using an image forming apparatus 1 according to a first embodiment of the present invention.

According to this embodiment, the image forming apparatus 1 is connected to a personal computer (PC) 2 via a network 3 such as a local area network (LAN), for example, a company LAN. The image forming apparatus 1 is a multifunction machine that has multiple functions including a printer function and a scanner function. The PC 2 is an information processor that receives instructions and inputs from a user. The user gives an instruction for printing (a print instruction) from the PC 2. In response to receiving the print instruction from the user, the image forming apparatus 1 executes processing. The print instruction may be input directly to the image forming apparatus 1.

The image forming apparatus 1 includes a scanner 11, an operations part 301, a Start key 302, a display screen 303, paper feed trays 304, a waste toner bottle cover 305, a temporary saving tray 306, a paper folding unit 307, a shift/staple unit 308, a finisher tray 309, and a proof tray 310. The scanner 11 is a document reader, whose configuration is described in detail below. The operations part 301 is for operating the image forming apparatus 1. The operations part 301 receives inputs through a liquid crystal display such as a touchscreen panel and through operation buttons. The Start key 302 receives an instruction to start a process of the image forming apparatus 1. The display screen 303 displays the status of a process of the image forming apparatus 1.

The paper feed trays 304 are loaded with recording media such as sheets of paper used in the image forming apparatus 1. In the following description, "paper" is an example of such recording media. The waste toner bottle cover 305 accommodates a waste toner bottle that stores waste or used toner. During processing, paper may be temporarily saved in the temporary saving tray 306 after being subjected to a process before being subjected to the next process. In response to an instruction to fold output paper, the paper folding unit 307 folds paper in four or three in accordance with the instruction. In response to an instruction to shift, staple, or punch output paper, the shift/staple unit 308 shifts, staples, or punches paper in accordance with the instruction. Paper is output onto the finisher tray 309 or the proof tray 310.

Applications and drivers for operating the image forming apparatus 1 are installed in the PC 2. The PC 2 converts a print image and parameters specified by a user into a signal corresponding to the protocol of the network 3. The PC 2 transmits the converted print image and parameters to the image forming apparatus 1 via the network 3, thereby giving a print instruction.

Figure 2:
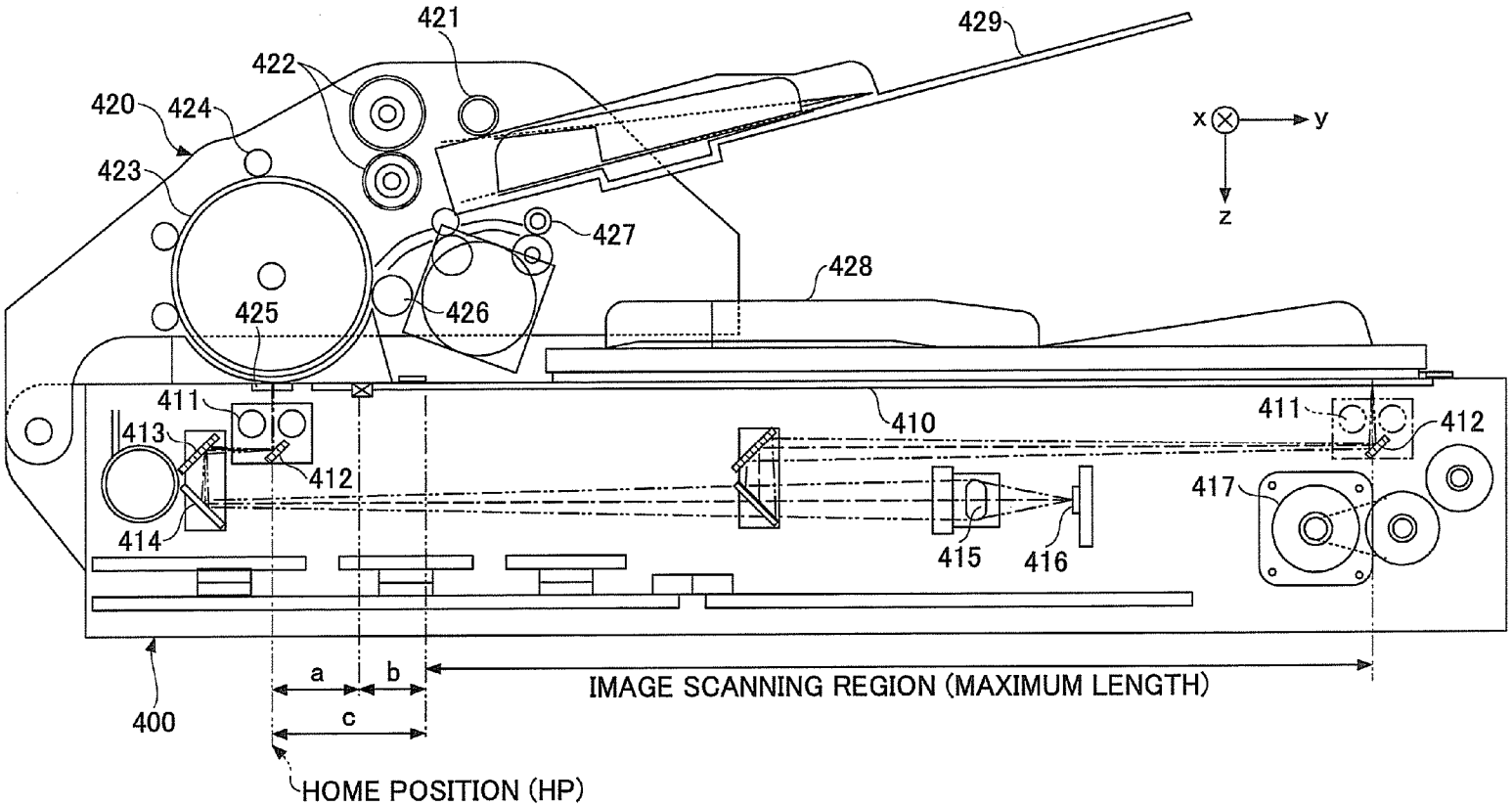
FIG. 2 is a schematic cross-sectional view of a scanner according to the first embodiment of the present invention.

Next, a description is given of a configuration of the scanner 11. FIG. 2 is a schematic cross-sectional view of the scanner 11. The scanner 11 includes a reading part 400 and an automatic document feeder (ADF) 420. In the scanner 11, the reading part 400 reads an original material such as a document, and the ADF 420 automatically feeds the original material to be read by the reading part 400.

The reading part 400 includes contact glass 410, a lighting lamp 411, a first mirror 412, a second mirror 413, a third mirror 414, a lens 415, a charge coupled device (CCD) 416, and a running body motor 417. The ADF 420 includes a pickup roller 421, a pair of registration rollers 422, a conveyor drum 423, a pressing roller 424, reading glass 425, paper output rollers 426 and 427, a paper output tray 428, and a document tray 429.

In the case of reading an original material manually placed on the contact glass 410 of the scanner 11, the original material placed on the contact glass 410 is exposed to light emitted from the lighting lamp 411, so that light reflected from the original material (image light) is reflected in a direction parallel to a sub scanning direction y by the first mirror 412. The lighting lamp 411 and the first mirror 412 are mounted on a first carriage (not graphically illustrated) that is driven in the sub scanning direction y at a constant speed. The second mirror 413 and the third mirror 414 are mounted on a second carriage (not graphically illustrated) that is driven in the same direction as the first carriage at a speed that is half the speed of the first carriage.

The image light reflected by the first mirror 412 is reflected downward (in a z direction) by the second mirror 413, and is reflected in the sub scanning direction y by the third mirror 414 to be focused onto the COD 416 by the lens 415 and converted into an electrical signal. The first carriage and the second carriage are driven forward in the sub scanning direction y (for original material scanning) and are driven backward (returned) in the opposite direction using the running body motor 417 as a drive source. The CCD 416 is an image capturing element that includes an array of multiple photoelectric conversion elements arranged in a main scanning direction x and repeatedly outputs the image reading signal of the array on a main scanning line basis.

The original material, for example, a sheet or paper, placed on the document tray 429 of the ADF 420 is fed into between the conveyor drum 423 and the pressing roller 424 by the pickup roller 421 and the registration rollers 422 to pass over the reading glass 425 while in close contact with the conveyor drum 423. Then, the original material is output onto the paper output tray 428, which also serves as a platen, below the document tray 429 by the paper output rollers 426 and 427. When passing over the reading glass 425, the original material is exposed to light from the lighting lamp 411, which is positioned to be stationary immediately below the reading glass 425. Light reflected from the original material enters the CCD 416 via the first mirror 412 and the subsequent optical system to be photoelectrically converted.

Figure 3:
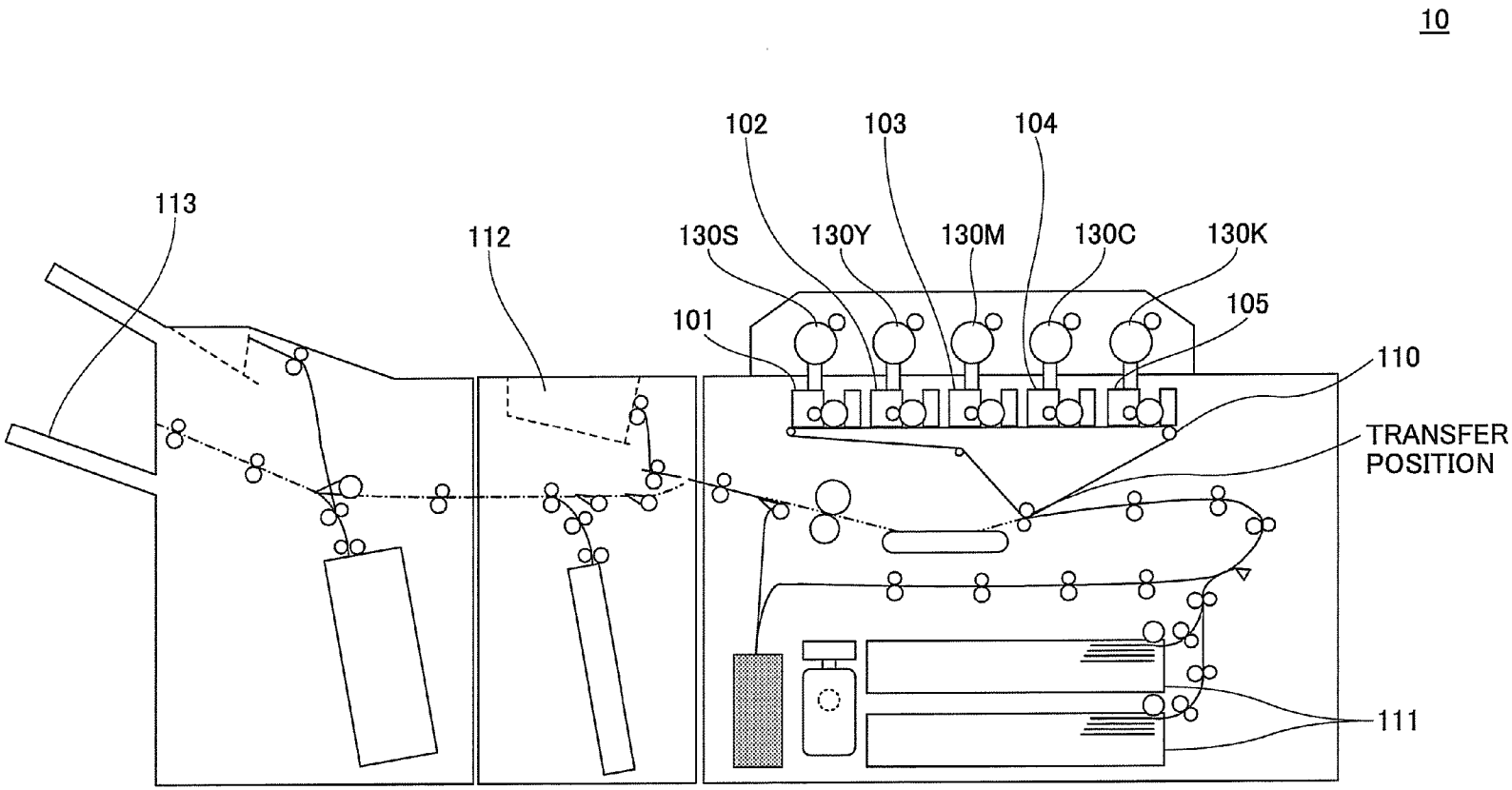
FIG. 3 is a schematic cross-sectional view of an image forming apparatus that operates as a printer according to the first embodiment of the present invention.

Next, an overview is given of functions of an image forming apparatus 10 related to this embodiment. The image forming apparatus 10 may be an example of the image forming apparatus 1. FIG. 3 is a schematic cross-sectional view of the image forming apparatus 10 that operates as a printer.

The image forming apparatus 10 includes paper feed tray 111, a transfer belt 110, an imaging (image forming) unit 101, an imaging unit 102, an imaging unit 103, an imaging unit 104, an imaging unit 105, a proof tray 112, and a finisher tray 113. The imaging unit 101 includes a toner bottle 130S, the imaging unit 102 includes a toner bottle 130Y, the imaging unit 103 includes a toner bottle 130M, the imaging unit 104 includes a toner bottle 130C, and the imaging unit 105 includes a toner bottle 130K. In FIG. 3, a conveyance path in which transfer paper is conveyed is indicated by a one dot chain line.

In response to a print instruction to the image forming apparatus 10, transfer paper is fed from one of the paper feed trays 111 to be conveyed in the conveyance path. Toner images are formed on the transfer belt 110 in the imaging units 101 through 105, and are carried on the transfer belt 110 as a composite toner image. The (composite) toner image carried on the transfer belt 110 is transferred onto the transfer paper that has been conveyed up to a transfer position, and is fused onto the transfer paper. The transfer paper on which the toner image has been fused is output onto the proof tray 112 or the finisher tray 113.

The toner bottle 130Y, the toner bottle 130M, the toner bottle 130C, and the toner bottle 130K are filled with yellow toner, magenta toner, cyan toner, and black toner, respectively. According to this embodiment, in addition to these toner bottles 130Y, 130M, 130C, and 130K, the image forming apparatus 10 further includes the toner bottle 130S, which is filled with toner of a specific color (specific color toner). Thus, a toner image of a specific color, a toner image of yellow, a toner image of magenta, a toner image of cyan, and a toner image of black are formed on the transfer belt 110 from the imaging unit 101, the imaging unit 102, the imaging unit 103, the imaging unit 104, and the imaging unit 105, respectively.

Next, a description is given of a potential order of toner bottles. According to this embodiment, for the purpose of convenience, the toner bottles 130S, 130Y, 130M, 130C, and 130K are arranged in this order in an upstream-downstream direction in the moving direction of the transfer belt 110 when the transfer belt 110 rotates clockwise in FIG. 3. However, this order is not fixed, and the toner bottles 130S, 130Y, 130M, 130C, and 130K may be arranged in any order. In the following description, the toner bottles 130S, 130Y, 130M, 130C, and 130K may be collectively referred to as "toner bottles 130" when no distinction is made between their respective toner colors.

In general, in full-color electrophotography, toners are superposed one over another based on order of formation of toner images, so that colors are expressed. The color of a first toner is expressed more strongly than the color of a second toner that precedes the first toner in the order of imaging (image formation). Further, when toner of a light color is printed (placed) on toner of a dark color, the light color is affected by the dark color.

The position of a toner bottle affects order of imaging. Therefore, when the position of a toner bottle of a specific color is fixed, depending on the specific color desired to be expressed, the color that a user wishes to express may not be expressed. For example, if a toner bottle of a specific color is positioned after a toner bottle of black in the order of imaging while the specific color is composed of light yellow that is highly transmissive to light, printing may not be performed with the user-intended specific color. According to this embodiment, toner of a specific color may be placed at any position, which makes it possible to print an image that expresses the specific color as intended by a user.

According to this embodiment, printing is performed using color toners of cyan (C), magenta (M), yellow (Y), and black (K) as process color in addition to a specific color toner. However, the process color is not limited to these four kinds. Further, multiple specific color toners may also be used.

Figure 4:
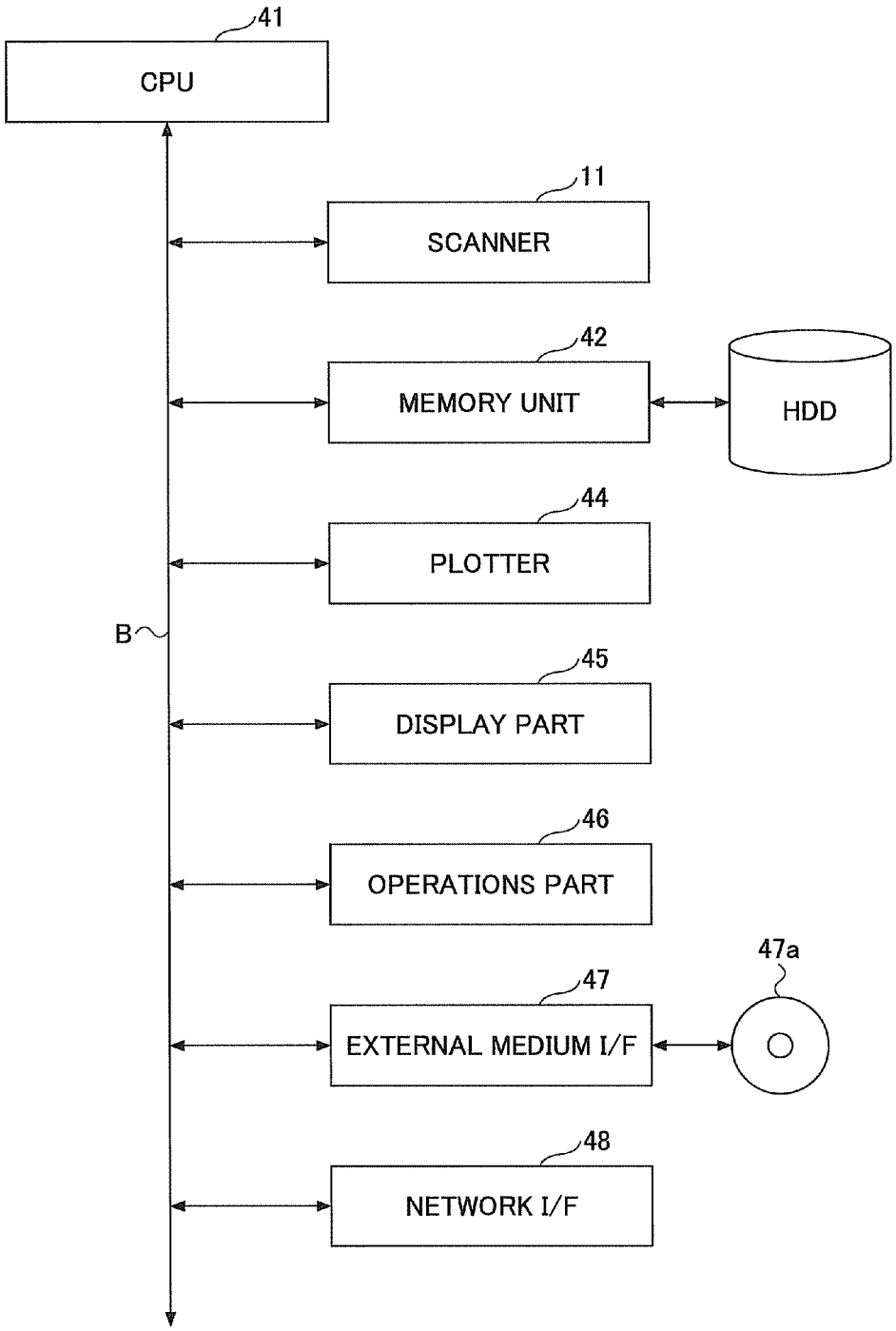
FIG. 4 is a diagram illustrating a hardware configuration of the image forming apparatus of FIG. 3 according to the first embodiment of the present invention.

Next, a description is given of a configuration of the image forming apparatus 10. FIG. 4 is a diagram illustrating a hardware configuration of the image forming apparatus 10.

The image forming apparatus 10 includes, in addition to the scanner 11, a central processing unit (CPU) 41, a memory unit 42, a plotter 44, a display part 45, an operations part 46, an external medium interface (I/F) 47, and a network I/F 48, which are interconnected by a bus B. The CPU 41 is a computational and control unit that executes processing in accordance with a program contained in the memory unit 42. The memory unit 42 includes a read-only memory (ROM), a random access memory (RAM), and a hard disk drive (HDD), and contains one or more programs executed by the image forming apparatus 10.

The plotter 44 prints images received by the image forming apparatus 10 through the scanner 11, the network I/F 48, and the external medium I/F 47. The display part 45 displays a graphical user interface (GUI) implemented by a program, and displays, for example, the remaining amounts of individual toners. The operations part 46 includes a liquid crystal display such as a touchscreen panel and operation buttons, and receives inputs of various operational instructions.

The external medium I/F 47 is an interface with external media such as DVDs and USB memories. A program contained in a storage medium 47*a* such as a DVD is loaded into the memory unit 42 via the external medium I/F 47. The network I/F 48 is an interface with the network 3 (FIG. 1). In the case of installing (downloading) a program via the network 3, the program is installed in the memory unit 42 via the network I/F 48.

Figure 5:
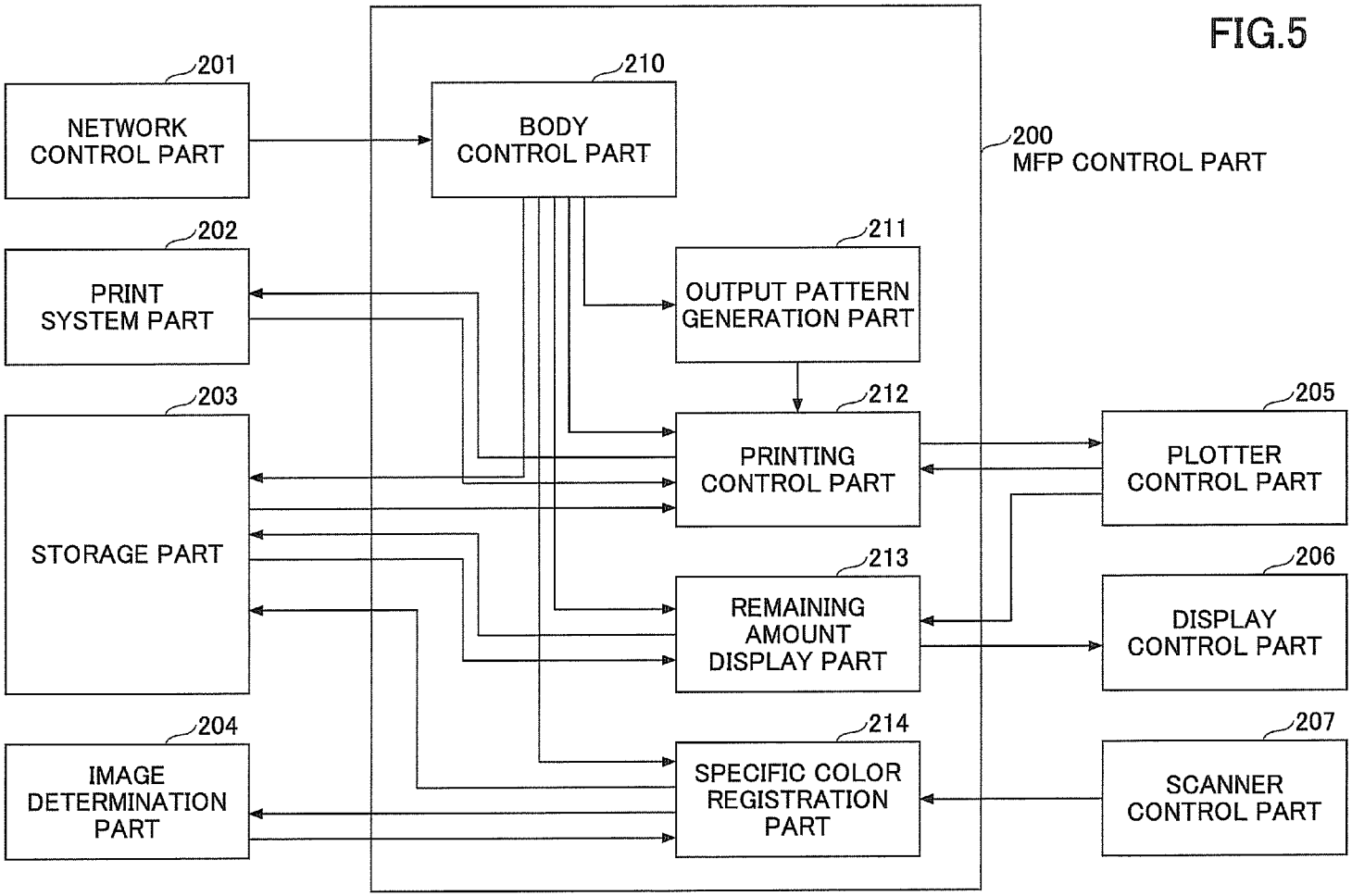
FIG. 5 is a functional block diagram illustrating the image forming apparatus of FIG. 3 according to the first embodiment of the present invention.

Next, a description is given, with reference to FIG. 5, of functions of the image forming apparatus 10. FIG. 5 is a functional block diagram illustrating the image forming apparatus 10. The image forming apparatus 10 may include elements other than those illustrated in the following description.

The image forming apparatus 10 includes a multifunction printer (MFP) control part 200, a network control part 201, a print system part 202, a storage part 203, an image determination part 204, a plotter control part 205, a display control part 206, and a scanner control part 207. The MFP control part 200 includes a body control part 210, an output pattern generation part 211, a printing control part 212, a remaining amount display part 213, and a specific color registration part 214.

The network control part 201 receives a print instruction from the PC 2, and transmits the print instruction to the body control part 210. The MFP control part 200 controls the image forming apparatus 10, and the CPU 41 (FIG. 4) executes processing. The body control part 210 controls the print instruction received via the network control part 201 and a print instruction directly received by the image forming apparatus 10. The body control part 210 stores image data received with the print instruction in the storage part 203.

The function of the storage part 203 is implemented by the memory unit 42. In addition to the image data received with the print instruction, the storage part 203 stores RGB components which are the color information of process color and the positions of color toners. The storage part 203 also stores the color information and the position of a specific color toner specified (identified) by the specific color registration part 214.

The print instruction received by the body control part 210 is transmitted to the printing control part 212. The printing control part 212 reads the image data from the storage part 203, and causes the print system part 202 to interpret the image data. The print system part 202 causes plain images that the print system part 202 generates by interpreting the image data to be output to the plotter control part 205. For example, the print system 202 analyzes input image data, and generates respective plain images of the color toners set in the image forming apparatus 10. According to this embodiment, in addition to four kinds of plain images of cyan (C), magenta (M), yellow (Y), and black (K), a plain image of a specific color (S) is also generated.

The plotter control part 205 controls the plotter 44 (FIG. 4), which is a printing device of the image forming apparatus 10. Based on an instruction from the printing control part 212, the plotter control part 205 causes the imaging units 130S, 130Y, 130M, 130C, and 130K corresponding to the respective colors of the plain images to form toner images and causes printing to be performed.

The output pattern generation part 211 generates an output pattern. The output pattern is formed of pattern images where the individual toners are output in respective strip shapes in accordance with the positions of the toners set in the image forming apparatus 10. By analyzing the output pattern, it is possible to determine the color components and the set position of a specific color toner, of which a description is given below. The output pattern generation part 211 generates an output pattern in response to receiving an instruction from the body control part 210. The generated output pattern is printed under the control of the printing control part 212.

The printed output pattern is read by the scanner 11 (FIG. 4) via the scanner control part 207, so that a specific color is extracted under the control of the specific color registration part 214. The specific color registration part 214 causes the image determination part 204 to analyze the read output pattern, and registers a specific color toner with the storage part 203 (that is, records a specific color toner in the storage part 203) based on the analyzed information. The image determination part 204 analyzes the color components of the output pattern, and identifies the color information of the specific color toner and identifies (determines) the position at which the specific color toner is installed (provided) in the image forming apparatus 10. The image determination part 204 transmits the identified information to the specific color registration part 214. The specific color registration part 214 causes the color components and the installation position of the specific color toner to be stored in the storage part 203.

As described below, the remaining amount display part 213 obtains information on the respective remaining amounts of the toners from the plotter control part 205 and reads the registered color components (RGB information) of the toners from the storage part 203, and transmits these information items to the display control part 206. The display control part 206 displays the remaining amounts of the toners using their respective toner colors.

Figure 6:
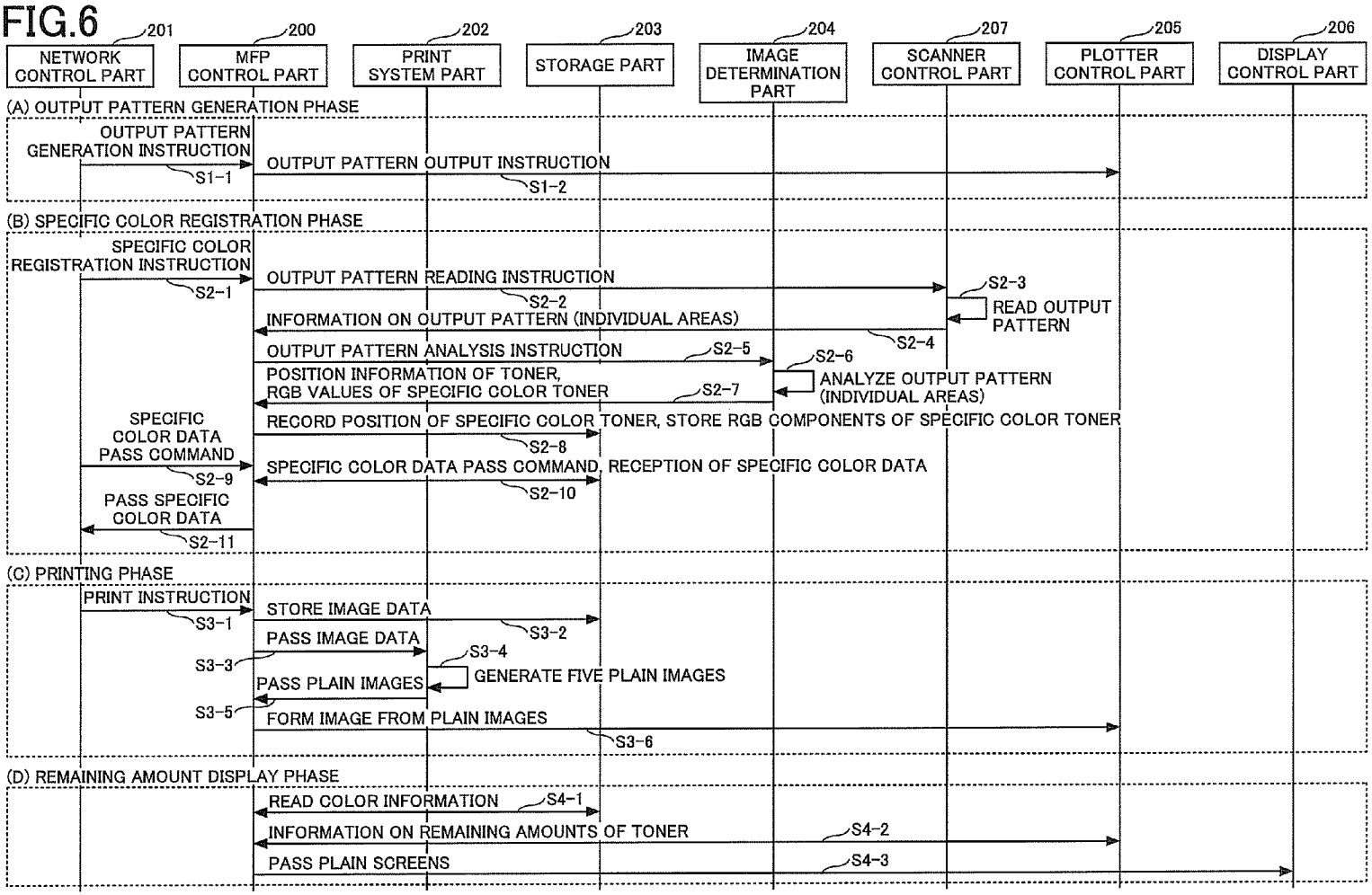
FIG. 6 is a sequence diagram illustrating a process of the image forming apparatus of FIG. 3 according to the first embodiment of the present invention.

Next, a description is given of a process of the image forming apparatus 10 in a time series. FIG. 6 is a sequence diagram illustrating a process of the image forming apparatus 10. In the following, a process of the image forming apparatus 10 according to this embodiment is described by dividing the process into four phases: (A) an output pattern generation phase; (B) a specific color registration phase; (C) a printing phase; and (D) a remaining amount display phase.

First, in (A) the output pattern generation phase, in step S1-1, the MFP control part 200 receives an instruction to generate an output pattern from the network control part 201. In step S1-2, the MFP control part 200 generates an output pattern, and instructs the plotter control part 205 to print the output pattern. In response to receiving the print instruction, the plotter control part 205 prints the output pattern.

Figure 7:
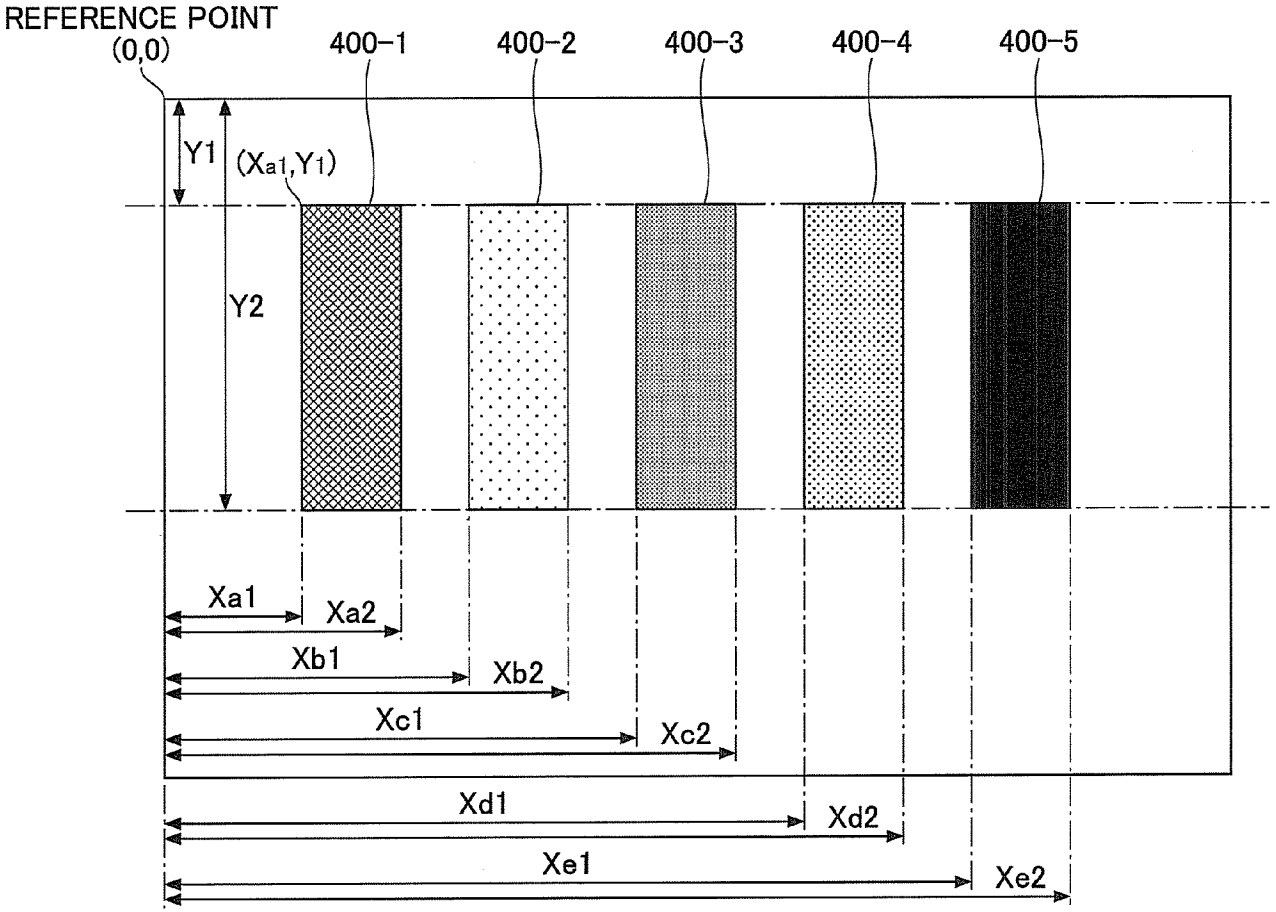
FIG. 7 is a diagram illustrating an output pattern according to the first embodiment of the present invention.

Here, a description is given of an example of the output pattern. FIG. 7 illustrates an example of the output pattern.

The output pattern generation part 211 generates pattern images for identifying toner colors in areas (regions) that are determined respectively for the set (installation) positions of the toner bottles 130 (imaging units 101 through 105). Here, the output pattern generation part 211 is controlled to have the output of the imaging unit 101, the output of the imaging unit 102, the output of the imaging unit 103, the output of the imaging unit 104, and the output of the imaging unit 105 in areas 400-1, 400-2, 400-3, 400-4, and 400-5, respectively. Accordingly, when the toners are provided at the positions as illustrated in FIG. 3, the area 400-1 is expressed with a specific color, the area 400-2 is expressed with yellow, the area 400-3 is expressed with magenta, the area 400-4 is expressed with cyan, and the area 400-5 is expressed with black. In the following, the areas 400-1 through 400-5 may be collectively referred to as "areas 400" for convenience of description.

Referring back to FIG. 6, a description is given of (B) the specific color registration phase. In step S2-1, the MFP control part 200 receives an instruction to register a specific color (a specific color registration instruction) from the network control part 201. In step S2-2, based on the specific color registration instruction, the MFP control part 200 instructs the scanner control part 207 to read the printed output pattern. In step S2-3, the scanner control part 207 controls the scanner 11 so that the scanner 11 scans paper on which the output pattern is printed, and in step S2-4, the scanner control part 207 returns the obtained image data of the output pattern to the MFP control part 200.

In step S2-5, the MFP control part 200 transmits the obtained image data of the output pattern to the image determination part 204, and commands the image determination part 204 to analyze the output pattern. In step S2-6, the image determination part 204 analyzes the output pattern using the received image data, and determines the respective RGB components of the individual areas 400-1 through 400-5 to determine the toner bottles 130 set at the respective positions of the imaging units 101 through 105.

This is described in more detail, referring again to FIG. 7. The image determination part 204 determines (recognizes), as the area 400-1, the area of a quadrangular pattern having vertices (Xa1, Y1) and (Xa2, Y2) with the left upper corner point of the output pattern being a reference point, and determines (recognizes) the area 400-1 as a printing with a toner provided in the imaging unit 101. The image determination part 204 reads the image of the area 400-1 and separates the color of the image into RGB components, thereby detecting the color of the toner provided in the imaging unit 101. Likewise, the image determination part 204 reads the images of the area 400-2, 400-3, 400-4, and 400-5 and separates the colors of the images into their respective RGB components, thereby detecting the colors of the toners provided in the individual imaging units 101 through 105.

Referring back to FIG. 6, in step S2-7, the image determination part 204 notifies the MFP control part 200 of the determined (located) positions of the toner bottles 130 and the determined color information of a specific color formed of its RGB components. In step S2-8, the MFP control part 200 transmits information on the positions of the toner bottles 130 to the storage part 203, and stores and records the color information of the specific color in the storage part 203. The MFP control part 200 also stores and records the color information of the toners other than the specific color toner in the storage part 203. The color information of the toners other than the specific color toner may be registered with the storage part 203 in advance before reading the output pattern.

Next, when a printing application downloaded in the PC 2 is started, in step S2-9, the MFP control part 200 receives a command to pass information on the specific color toner from the PC 2 via the network control part 201. In step S2-10, the MFP control part 200 reads information indicating the RGB components of the specific color toner from the storage part 203. In step S2-11, the MFP control part 200 transmits the read information to the PC 2 via the network control part 201.

This passing of the information indicating the RGB components of the specific color toner to the PC 2 may also be performed at a time other than the time of starting the printing application by the PC 2. For example, toner information may be passed to the PC 2 when there is a change in the condition of the remaining amount of toner. Further, every time printing is performed, a transmission request may be received from the PC 2, and toner information may be transmitted to the PC 2 in response to the transmission request.

According to this embodiment, by generating and reading a predetermined output pattern, it is possible to determine the position and the color information of a specific color toner and to register a specific color with an image forming apparatus. This configuration makes it possible to register information on a specific color toner without special knowledge, thus reducing a user's workload.

Next, a description is given of (C) the printing phase. In step S3-1, the network control part 201 receives a print request from the PC 2, and transmits the print request to the MFP control part 200. In step S3-2, the MFP control part 200 stores image data received with the printing instruction in the storage part 203. In step S3-3, the MFP control part 200 instructs the print system part 202 to generate plain images. In step S3-4, in response to receiving the instruction to generate plain images, the print system part 202 interprets the image data stored in the storage part 203, and generates plain images to be printed with the individual toners. In step S3-5, the print system part 202 transmits the generated plain images to the MFP control part 200. In step S3-6, the MFP control part instructs the plotter control part 205 to print the plain images. In response to receiving the print instruction, the plotter control part 205 performs printing based on the plain images.

Figure 8:
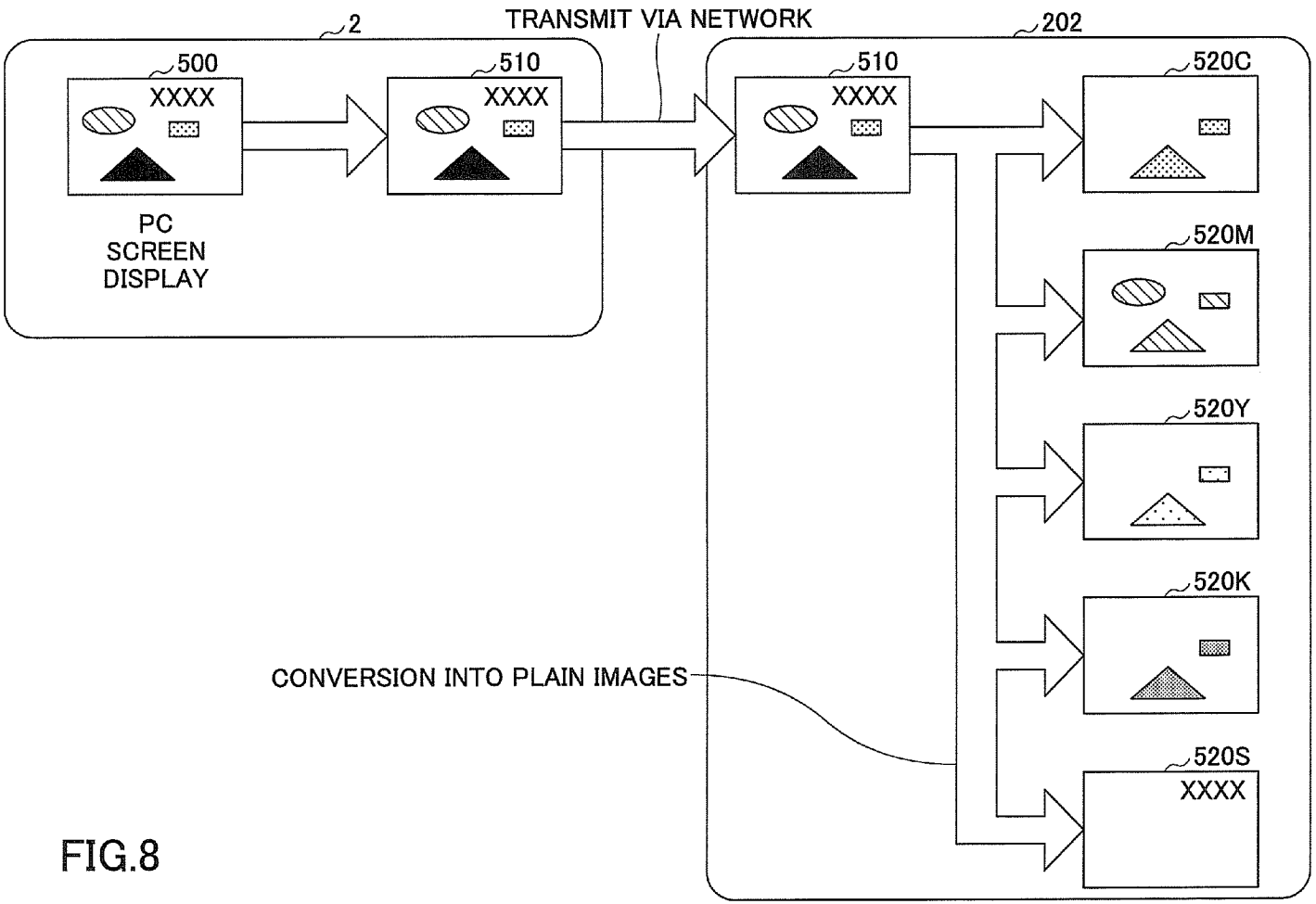
FIG. 8 is a diagram illustrating an overview of plain image generation according to the first embodiment of the present invention.

Here, a description is given of plain images generated in the print system part 202. FIG. 8 is a diagram illustrating an overview of plain image generation. A description is given below of the case of instructing the image forming apparatus 10 to perform printing from the PC 2.

When a figure or letters 500 desired to be printed in a specific color are specified with the specific color on a printing application downloaded in the PC 2, the specific color is reproduced from the color information of the specific color received at the time of starting the application, and the specified part (figure or letters) 500 is displayed in the reproduced specified color. Thereafter, in the PC 2, the image data of an image displayed on a screen is converted into an image file 510 of a format such as PDL (page description language), and the converted image data are transmitted to the image forming apparatus 10 via the network 3.

In the image forming apparatus 10, the network control part 201 receives a print instruction from the PC 2, the MFP control part 200 instructs the print system part 202 to generate plain images from the received image data. The print system part 202 analyzes the image data, and generates plain images. The plain images are images that are printed with the respective toners set in the image forming apparatus 10. According to this embodiment, there are five color toners of cyan (C), magenta (M), yellow (Y), black (K), and a specific color (S). Therefore, five plain images, that is, a cyan plain image 520C, a magenta plain image 520M, a yellow plain image 520Y, a black plain image 520K, and a specific color plain image 520S, are generated. At this point, the figure or letters 500 specified with the specific color on the application are interpreted as the specific color plain image 520S, and are printed using the toner bottle 130S of the registered specific color.

Figure 9:
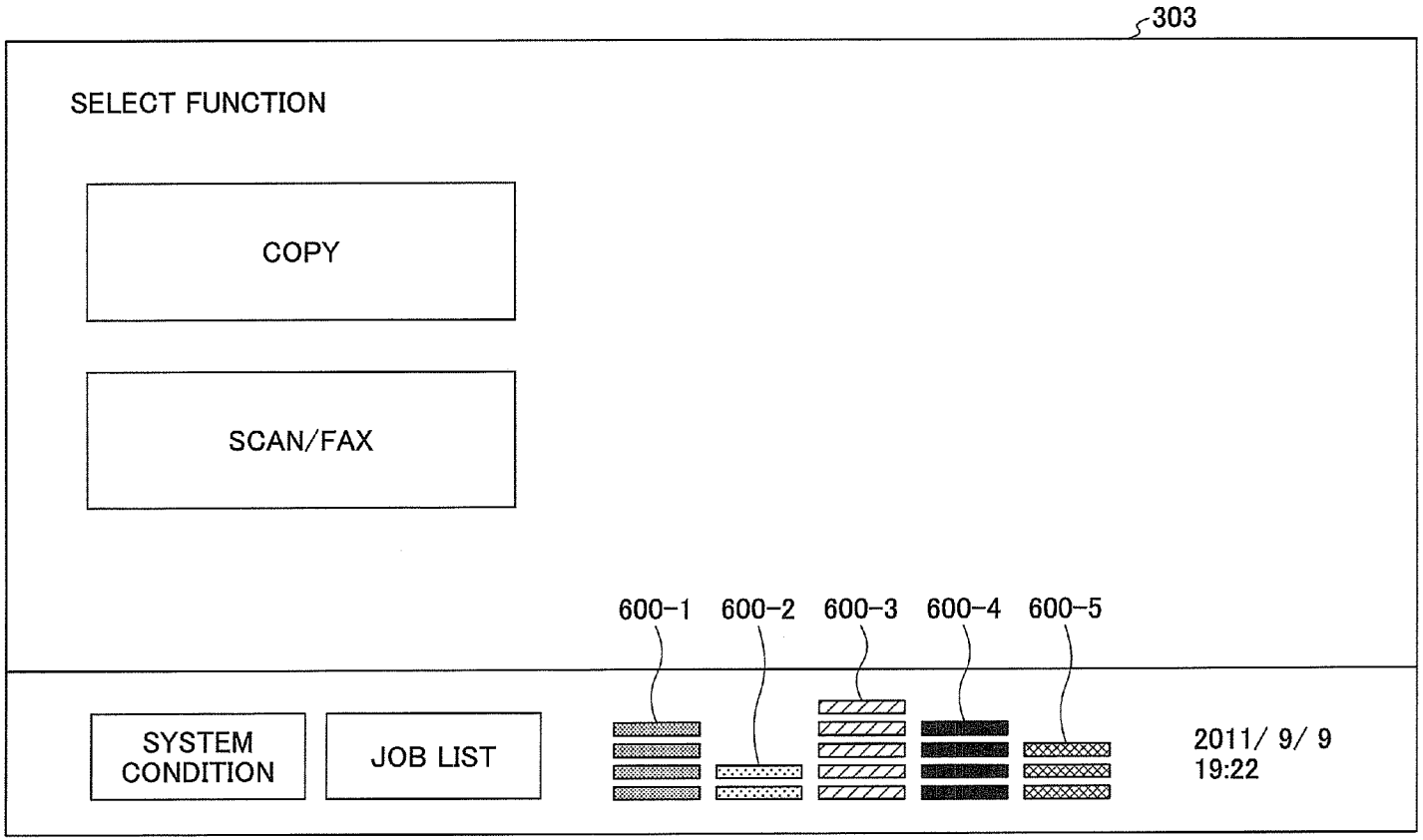
FIG. 9 is a diagram illustrating toner condition display of the image forming apparatus of FIG. 3 according to the first embodiment of the present invention.

Next, a description is given of (D) the remaining amount display phase of FIG. 6. In the case of displaying the remaining amounts of the toners including the specific color toner in the image forming apparatus 10 after the registration of the specific color with the image forming apparatus 10, in step S4-1, the remaining amount display part 213 of the MFP control part 200 reads the color information of the toners including the specific color toner from the storage part 203. Further, in step S4-2, the remaining amount display part 213 of the MFP control part 200 obtains information on the remaining amounts of the toners from the plotter control part 205. The remaining amount display part 213 generates three plain screens of R (red), G (green), and B (blue) of a remaining amount display screen as illustrated in FIG. 9 based on the color information of the toners obtained in step S4-1 and the information on the remaining amounts of the toners obtained in step S4-2.

In step S4-3, the generated three plain screens are passed from the remaining amount display part 213 to the display control part 206. The display control part 206 displays the plain screens on the display screen 303 (FIG. 1), so that the remaining amounts of the toners are displayed using their respective colors.

A description is given of display of the remaining amounts of toner of the toner bottles 130. FIG. 9 is a diagram illustrating toner condition display of the image forming apparatus 10. In FIG. 9, as toner conditions, the remaining amounts of toner of the toner bottles 130 are displayed on the display screen 303.

The remaining amounts of toner of the toner bottles 130K, 130C, 130M, 130Y, and 130S are displayed in areas 600-1, 600-2, 600-3, 600-4, and 600-5, respectively. The remaining amounts of toner of the set toner bottles 130K, 130C, 130M, 130Y, and 130S are indicated by the number of bars. A smaller number of bars indicates a smaller remaining amount of toner.

The respective bars are displayed in actual toner colors to be easy for users to understand. Therefore, with respect to the remaining amount of a specific color toner, the remaining amount display part 213 reads the color information (RGB information) of the specific color toner recorded in the storage part 203, generates plain screens of R, G, and B so as to reproduce the actual color of the specific color toner, and transmits the plain screens to the display control part 206. As a result, the display control part 206 is allowed to display the remaining amount of the specific color toner using the reproduced specific color.

According to this configuration, even when a specific color toner, which is toner of any color of a user, is provided, it is possible to display a toner condition in the actual color of the specific color toner, which conveniently helps visual understandings.

Figure 10:
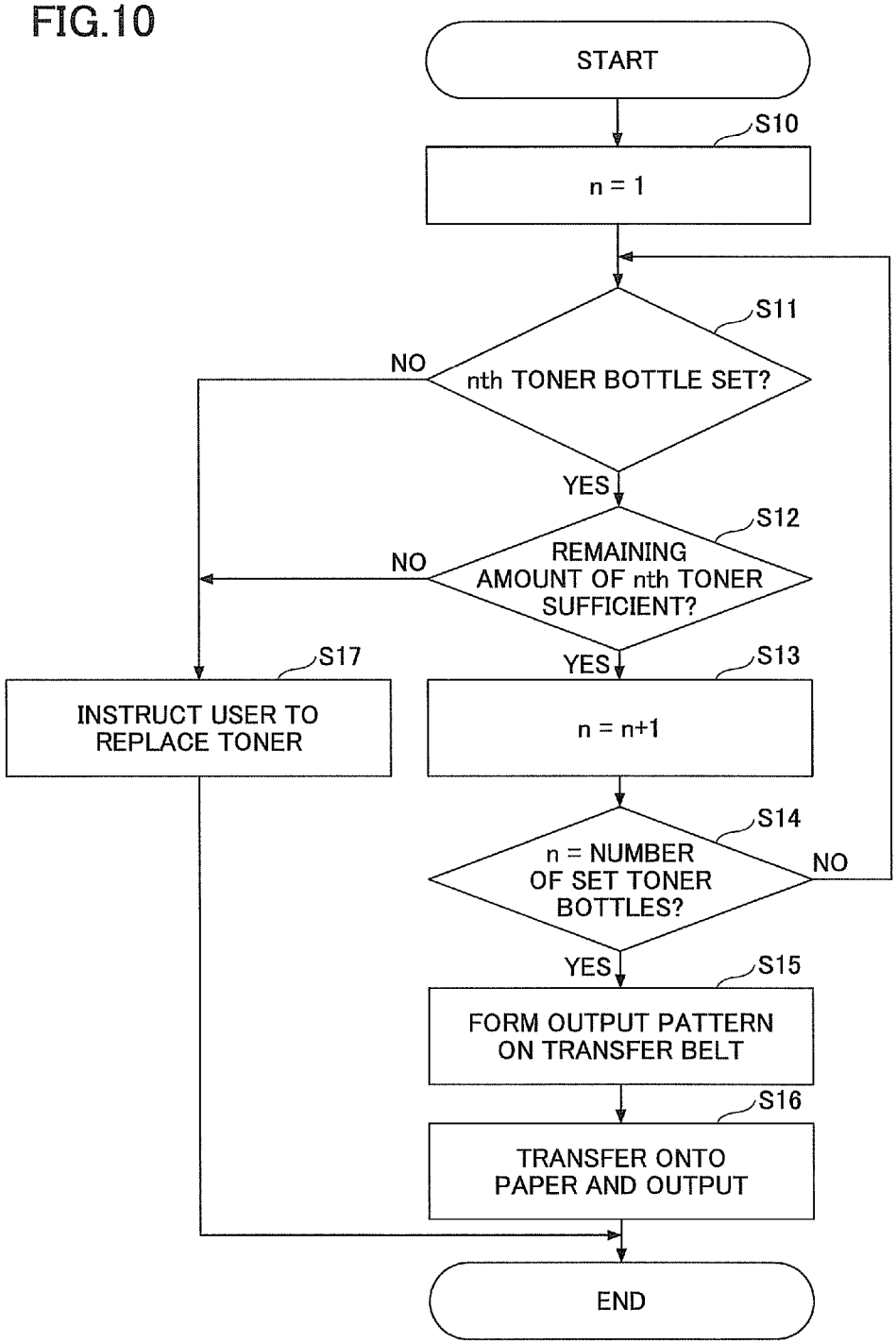
FIG. 10 is a flowchart illustrating a process for printing an output pattern according to the first embodiment of the present invention.

Next, a description is given of printing an output pattern. FIG. 10 is a flowchart illustrating a process for printing an output pattern. Here, a description is given of the case where the number of toner bottles 130 installed (provided) is M. In the process illustrated in FIG. 10, the nth toner bottle 130 (n=1, 2, 3, 4 . . . M) is checked nth. After checking the first (n=1) toner bottle 130, the second (n=2) toner bottle 130, the third (n=3) toner bottle 130, the fourth (n=4) toner bottle 130 . . . and finally the Mth (n=M) toner bottle 130 are checked. Thereafter, the output pattern is formed and printed.

First, in step S10, n is set to 1 (n=1) in starting the process. When the printing control part 212 instructs the plotter control part 205 to print the output pattern generated by the output pattern generation part 211, in step S11, the plotter control part 205 determines whether the first toner bottle 130 is set (installed). When the first toner bottle 130 is set (YES in step S11), in step S12, the plotter control part 205 determines whether the remaining amount of toner of the first toner bottle 130 is sufficient. When the remaining amount of toner of the first toner bottle 130 is sufficient (YES in step S12), in step S13, the value of n is incremented by one (n=n+1). The process of steps S11 and S12 is repeated the number of installed toner bottles 130, M, including the first process (for the first toner bottle 130). When it is determined in step S11 that the nth toner bottle 130 is not set (NO in step S11) or when it is determined in step S12 that the remaining amount of toner of the nth toner bottle 130 is not sufficient (NO in step S12), in step S17, an instruction to replace toner is given to a user, and the process ends.

In step S14, it is determined whether the installation of the toner bottle 130 and the remaining amount of toner have been determined as many times as the number of installed toner bottles 130 (=M). If the installation of the toner bottle 130 and the remaining amount of toner have been determined as many times as the number of installed toner bottles 130 (YES in step S14), in step S15, the plotter control part 205 causes the output pattern to be formed on the transfer belt 110 (FIG. 3). In step S16, the plotter control part 205 causes the output pattern formed on the transfer belt 110 to be transferred onto and printed on paper to be output.

Figure 11:
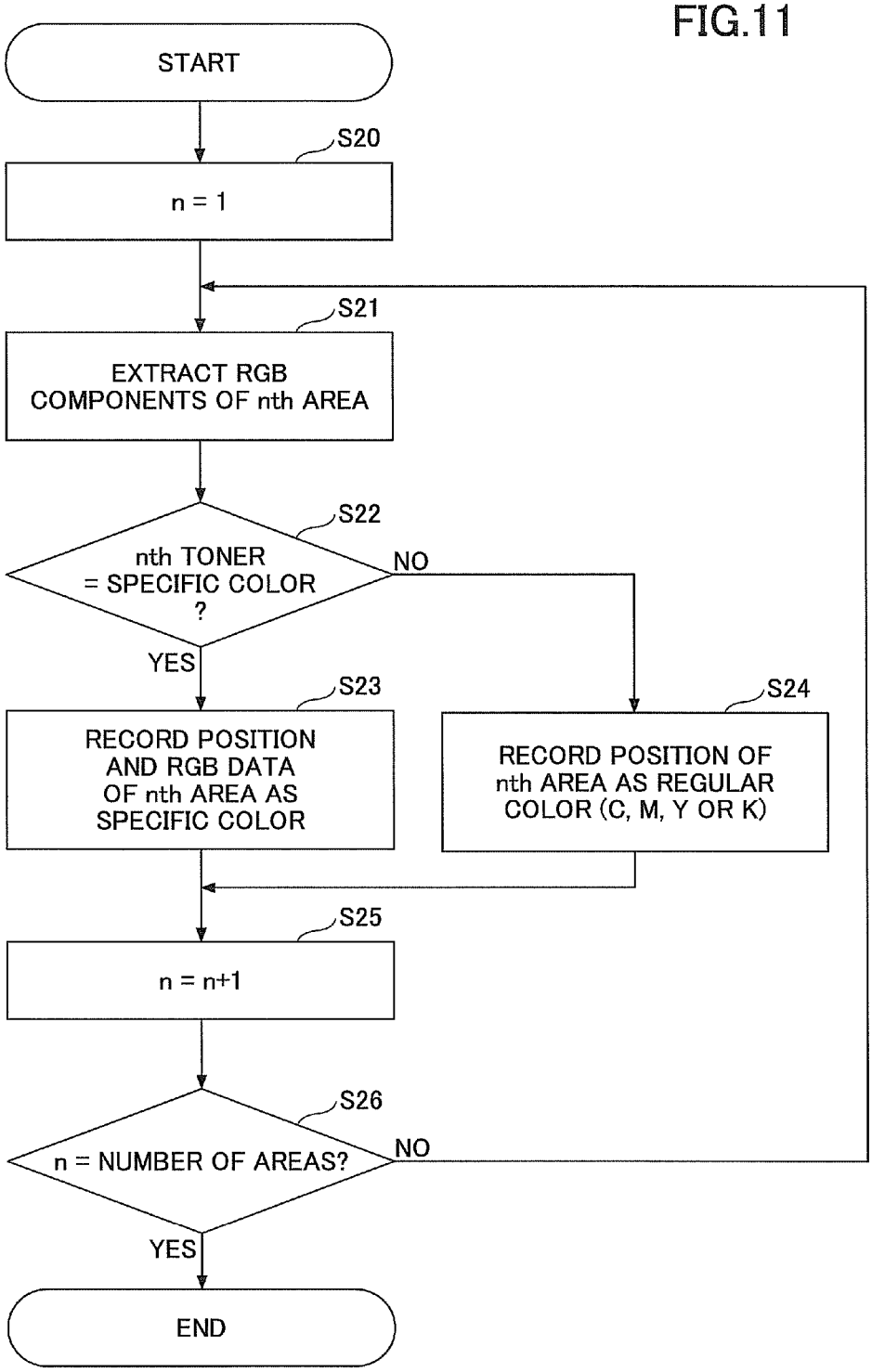
FIG. 11 is a flowchart illustrating a process for analyzing toner according to the first embodiment of the present invention.

Next, a description is given of a toner registration process. FIG. 11 is a flowchart illustrating a process for analyzing toner. Here, it is assumed that the number of areas 400 output in the output pattern is N, and that the areas 400 are labeled as the first, second, third . . . and Nth areas 400-*n* (n=1, 2, 3 . . . N) from left to right in FIG. 7. The first through Nth areas 400 are successively analyzed and corresponding information is recorded (registered).

First, in step S20, n is set to 1 (n=1) in starting the process. In step S21, first, the image determination part 204 analyzes an image with respect to the leftmost (first) area 400-1, and detects (determines) the RGB components of the image. In step S22, the image determination part 204 determines, based on the RGB components extracted (detected) in step S21, whether the area 400-1 is printed with a specific color toner. The RGB components of process color (C, M, Y, and K) are prestored in the storage part 203. The image determination part 204 compares the RGB components of process color and the extracted RGB components, and determines that the area 400-1 is printed with a specific color when the extracted RGB components are different from those of process color.

When the image determination part 204 determines that the area 400-1 is printed with a specific color toner (YES in step S22), in step S23, the image determination part 204 specifies (identifies) the position of an imaging unit (for example, the imaging unit 101 in FIG. 3) corresponding to the area 400-1, and notifies the MFP control part 200 of the specified position of the imaging unit and the detected RGB components as information on the specific color toner. The MFP control part 200 records the position of the toner bottle 130 of the specific color toner, which is determined from the position of the imaging unit of which the MFP control part 200 has been notified, and the RGB components of the specific color toner in the storage part 203.

When the image determination part 204 determines in step S22 that the area 400-1 is not printed with a specific color toner (NO in step S22), in step S24, the image determination part 204 determines, from the result of the comparison with the RGB components of process color stored in the storage part 203, which process color of C, M, Y, and K the detected RGB components correspond to. The image determination part 204 notifies the MFP control part 200 of the determined process color and the position of an imaging unit corresponding to the area 400-1. The MFP control part 200 records the position of the toner bottle 130 of a color toner, which is determined from the position of the imaging unit of which the MFP control part 200 has been notified, and the RGB components of the color toner in the storage part 203.

In step S25, n is incremented by one (n=n+1), and the process of steps S21, S22, and S23 or steps S21, S22, and S24 is repeated as many times as the number of areas 400 output in the output pattern. When it is determined in step S26, all the areas 400 have been subjected to this process (YES in step S26), the process ends.

The registration process is performed by reading a generated output pattern and determining the color information and the position of toner output in each area. In the case of using a specific color toner, it is possible to record (register) the color components and the position of a toner bottle of the specific color toner without special knowledge, thus reducing a user's workload.

[b] Second Embodiment

Figure 12:
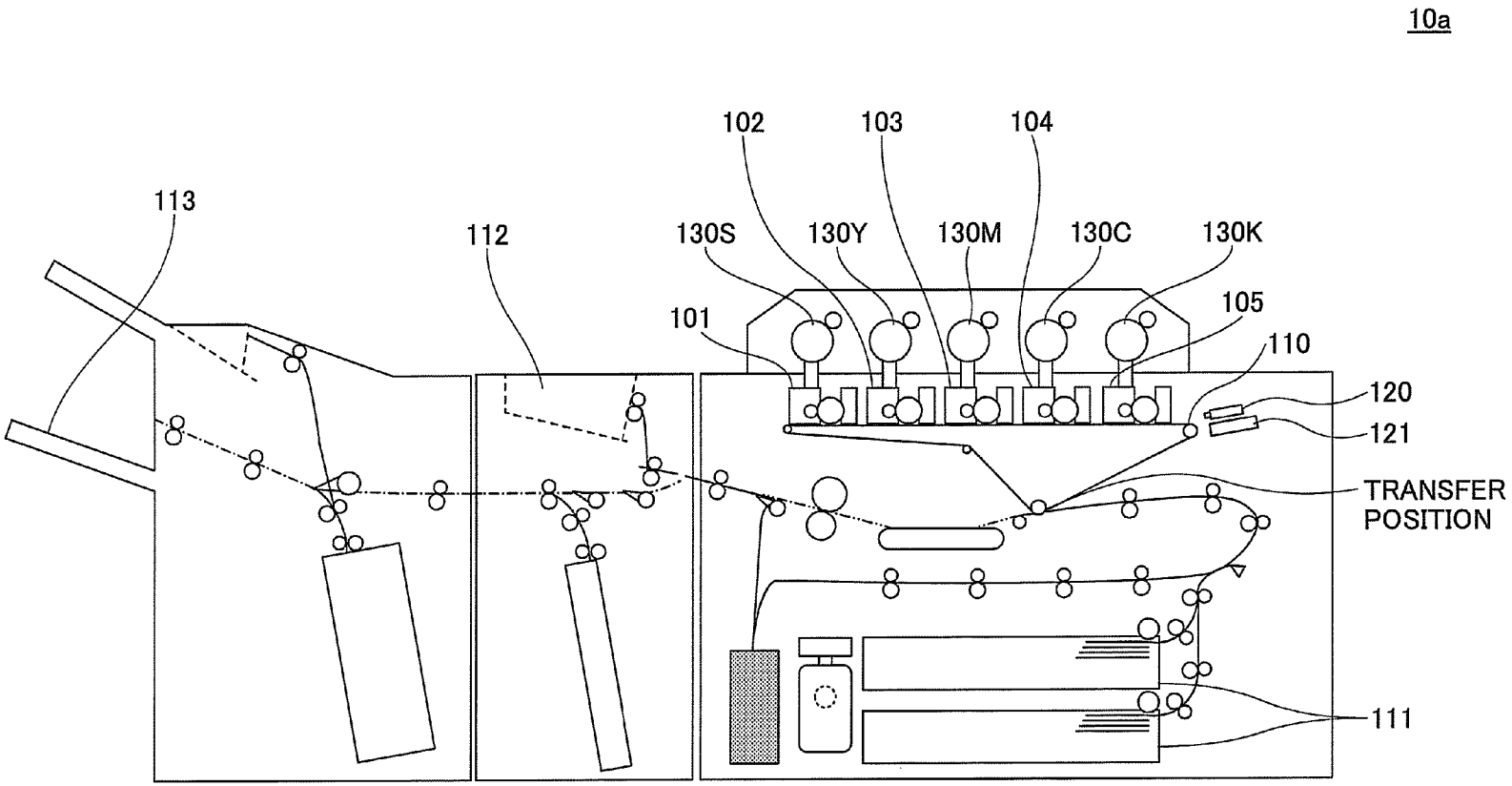
FIG. 12 is a schematic cross-sectional view of an image forming apparatus according to a second embodiment of the present invention.

Next, a description is given of a second embodiment. In the second embodiment, the position and the color information of a specific color toner are registered (recorded) using an output pattern formed on the transfer belt 110. FIG. 12 is a schematic cross-sectional view of an image forming apparatus according to the second embodiment. In the following, a description is given of differences from the first embodiment. The same elements or configurations as those of the first embodiment are referred to by the same reference numerals, and a description thereof is omitted.

An image forming apparatus 10*a* according to this embodiment includes a CCD 120 and a light source 121. The light source 121 may be a superluminescent white light-emitting diode (LED). The light source 121 emits light onto the transfer belt 110, and light reflected from the transfer belt 110 is received by the CCD 120. The CCD 120 is an image sensor that reads the output pattern formed on the transfer belt 110. According to this embodiment, after the output pattern illustrated in FIG. 7 is formed on the transfer belt 110, the output pattern formed on the transfer belt 110 is read with the CCD 120, and the RGB components of each of the areas 400 are analyzed.

According to the second embodiment, of the sequence diagram of FIG. 6, step S1-1 is an instruction to record (register) an output pattern, and based on an instruction to output an output pattern in step S1-2, the plotter control part 205 causes an output pattern to be formed on the transfer belt 110. Further, the output pattern is read successively after the formation of the output pattern on the transfer belt 110. Therefore, it is assumed that the specific color registration instruction of step S2-1 has already been accepted, so that (B) the specific color registration phase is entered successively after (A) the output pattern generation phase.

This configuration makes it possible to register a specific color toner with an image forming apparatus by causing toner-related information to be stored in the image forming apparatus without paper consumption.

In the above-described embodiment, the contents of output in each of areas in an output pattern may correspond to a pattern image formed by an imaging part. The RGB information analyzed by the image determination part 204 may correspond to color information.

All examples and conditional language provided herein are intended for pedagogical purposes of aiding the reader in understanding the invention and the concepts contributed by the inventor to further the art, and are not to be construed as limitations to such specifically recited examples and conditions, nor does the organization of such examples in the specification relate to a showing of the superiority or inferiority of the invention. Although one or more embodiments of the present invention have been described in detail, it should be understood that the various changes, substitutions, and alterations could be made hereto without departing from the spirit and scope of the invention.

What is claimed is:

1. An image forming apparatus, comprising:

an imaging unit configured to form pattern images in areas corresponding to positions at which toners including a specific color toner of a specific color are provided;

a reading unit configured to read the formed pattern images;

a color information detection unit configured to analyze color information of the read pattern images and detect the color information of the specific color toner;

a position determination unit configured to determine the position at which the specific color toner is provided from a position at which the pattern image of the specific color is formed in the read pattern images; and a recording unit configured to record the detected color information of the specific color toner and the position at which the specific color toner is provided.

2. The image forming apparatus as claimed in claim 1, further comprising:

a toner condition detection unit configured to detect conditions of the toners; and a display unit configured to display the condition of the specific color toner on a screen of a display part of the image forming apparatus using the color information of the specific color toner detected by the color information detection unit.

3. The image forming apparatus as claimed in claim 1, wherein the reading unit is configured to read the pattern images formed by the imaging unit and printed on paper using a scanner.

4. The image forming apparatus as claimed in claim 1, wherein the imaging unit is configured to form the pattern images on a transfer belt, and the reading unit is configured to read the pattern images formed on the transfer belt.

5. The image forming apparatus as claimed in claim 1, further comprising:

a specific color transmission unit configured to transmit the color information of the specific color toner detected by the color information detection unit to an information processor connected to the image forming apparatus via a network.

6. An image forming method, comprising:

forming pattern images in areas corresponding to positions at which toners including a specific color toner of a specific color are provided;

reading the formed pattern images;

analyzing color information of the read pattern images and detecting the color information of the specific color toner;

determining the position at which the specific color toner is provided from a position at which the pattern image of the specific color is formed in the read pattern images; and recording the detected color information of the specific color toner and the position at which the specific color toner is provided.

7. The image forming method as claimed in claim 6, further comprising:

detecting conditions of the toners; and displaying the condition of the specific color toner on a screen using the color information of the specific color toner detected by said detecting the color information of the specific color toner.

8. A non-transitory computer-readable storage medium storing a program for causing a computer to execute the image forming method as set forth in claim 6.

* * * * *